United States Patent [19]

Ferguson et al.

[11] Patent Number: 4,463,082

[45] Date of Patent: Jul. 31, 1984

[54] SILVER DIFFUSION TRANSFER FILM UNIT WITH NOBLE METAL COMPOUND AS STABILIZER

[75] Inventors: John H. Ferguson, Attleboro; Kenneth S. Norland, Lexington; Stephen R. Sofen, Cambridge, all of Mass.

[73] Assignee: Polaroid Corporation, Cambridge, Mass.

[21] Appl. No.: 486,395

[22] Filed: Apr. 19, 1983

[51] Int. Cl.[3] ..... G03C 5/54; G03C 7/04; G03C 1/34

[52] U.S. Cl. ..... 430/228; 430/233; 430/245; 430/248; 430/611

[58] Field of Search ..... 430/233, 248, 228, 245, 430/428, 429, 611, 612

[56] References Cited

U.S. PATENT DOCUMENTS 3,062,654 11/1962 Allen et al. ..... 430/611
3,704,126 11/1972 Lard et al., ..... 430/233
4,279,983 7/1981 Bilofsky et al. ..... 430/233

*Primary Examiner*—Richard L. Schilling
*Attorney, Agent, or Firm*—Philip G. Kiely

[57] ABSTRACT

A silver diffusion transfer film unit comprising photosensitive silver halide, silver precipitating nuclei, a stabilizing compound of the formula $$XS(CH_2)_nCOOR$$

wherein X is a noble metal below silver in the Electromotive Series of Elements, n is 1, 2 or 3 and R is an alkyl or substituted alkyl group; and a compound of the formula $$H_xS_y[(CH_2)_bCOOZ]_m$$

wherein Z is hydrogen or alkyl, b is 1, 2 or 3, m=1 or 2, x=1 or 0 and y=1 or 2; when y=2, m=2 and x=0 and when y=1, m=1 and x=1.

18 Claims, No Drawings

SILVER DIFFUSION TRANSFER FILM UNIT WITH NOBLE METAL COMPOUND AS STABILIZER

BACKGROUND OF THE INVENTION

Procedures for preparing photographic images in silver by diffusion transfer principles are well known in the art. For the formation of the positive silver image, a latent image contained in an exposed photosensitive silver halide emulsion is developed and almost concurrently therewith a soluble silver complex is obtained by reaction of a silver halide solvent with unexposed and undeveloped silver halide of said emulsion. The photosensitive silver halide emulsion is developed with a processing composition which may be spread between the photosensitive element comprising the silver halide emulsion and a second element which may comprise a suitable silver precipitating layer. The processing composition effects development of the latent image in the emulsion and, substantially contemporaneous therewith, forms a soluble silver complex, for example, a thiosulfate or thiocyanate, with undeveloped silver halide. This soluble silver complex is at least in part transported in the direction of the print receiving layer and the silver thereof is precipitated in the silver precipitating element to form a positive image.

Additive color reproduction may be produced by exposing a photosensitive silver halide emulsion through an additive color screen having filter media or screen elements each of an individual additive color such as red or green or blue and by viewing the reversed or positive silver image formed by transfer to a transparent print receiving element through the same or a similar screen which is suitably registered with the positive image carried in the print receiving layer. As examples of suitable film structures for employment in additive color photography, mention may be made of U.S. Pat. Nos. 2,861,885; 2,726,154; 2,944,894; 3,536,488; 3,615,426; 3,615,427; 3,615,428; 3,615,429; and 3,894,871.

U.S. Pat. No. 4,056,392, issued Nov. 1, 1977, is directed to a diffusion transfer film unit which comprises, in order, an additive color screen, a layer comprising silver precipitating nuclei, a layer comprising a water-soluble cupric salt and a compound selected from the group consisting of chitosan and 2-amino-2-deoxyglucose, and a photosensitive silver halide emulsion layer. By employing a water-soluble copper salt in the chitosan protective layer, an increase in $D_{max}$ is achieved with substantially no adverse effect on $D_{min}$ compared to a protective layer composed of chitosan alone.

Enhanced image stability can be provided to silver images by the employment of noble metal compounds containing a noble metal below silver in the Electromotive Series of Elements. A preferred system also includes the employment of an $\alpha,\beta$-enediol silver halide developing agent. Film units and processes disclosing and claiming such stabilization are set forth in U.S. Pat. Nos. 3,704,126, issued Nov. 38, 1972; 3,730,716, issued May 1, 1973; and 3,821,000, issued June 28, 1974.

U.S. Pat. No. 4,279,983, issued on June 21, 1981, is directed to photographic film units and processes employing a noble metal compound adapted to provide enhanced stability to a silver image, said noble metal compound or complex being substantially non-diffusible until the ligand is hydrolyzed, said compound consisting of a noble metal complexed with a ligand adapted to hydrolyze in aqueous alkali to provide a diffusible complex of said noble metal. The noble metal compound may be disposed in various locations in the film unit including a layer adjacent to the layer in which the image silver is to be located.

The preferred compound is represented by the formula $$X—S—(CH_2)_n—COOR$$

wherein X is a noble metal more noble than silver, n is 1, 2 or 3 and R is an alkyl or substituted alkyl group which may be removed by alkaline hydrolysis.

SUMMARY OF THE INVENTION

The present invention is directed to photographic silver diffusion transfer film units employing a stabilizer of the formula $$X—S—(CH_2)_n—COOR \quad (1)$$

wherein X is a noble metal more noble than silver, i.e., below silver in the Electromotive Force Series of Elements, n is 1, 2 or 3 and R is an alkyl group or substituted alkyl group which may be removed by alkaline hydrolysis, and a compound of the formula $$H_xS_y[(CH_2)_bCOOZ]_m \quad (2)$$

wherein Z is hydrogen or alkyl, n is 1, 2 or 3, m=1 or 2, x=1 or 0 and y=1 or 2; wherein y=2, m=2 and x=0 and when y=1, m=1 and x=1.

DETAILED DESCRIPTION OF THE INVENTION

It has now been found that the preprocessing stability (i.e., shelf life) of silver diffusion transfer film units containing the noble metal stabilizer of formula (1), above, can be enhanced by disposing in the film unit, the mercaptan or disulfides of Formula (2), above. It is unexpected that such an additive can provide an improvement in the film unit's storage stability when one would expect the opposite to occur since mercaptans are considered to be emulsion poisons, as evidenced by the increase in fog level observed when an emulsion is overripened in the presence of a sulfur-containing ripening agent. Such an increase in fog level is not found in the present invention.

As examples of suitable mercaptans and disulfides for use in the present invention, mention may be made of the following.

Dithiodiglycolic acid
Dithiodipropanoic acid
Methyl thioglycolate
Ethyl thioglycolate
Thioglycolic acid
Propyl thioglycolate In a preferred embodiment, dithiodiglycolic acid is employed.

EXAMPLE A

A film unit was prepared comprising a transparent polyester film base and carrying on one surface an additive color screen of approximately 1000 lines each per inch of red, blue, and green filter screen elements in repetitive side by side relationship; a copper iodide-polyvinyl formal antistat layer; a barrier layer comprising polyvinylidine chloride latex, polyvinyl formal and lacquer polyvinylidine chloride; a nucleating layer comprising palladium nuclei at a coverage of about 0.16 mg/ft$^2$ of palladium of 0.20 mg/ft$^2$ of gelatin and 1.0 mg/ft$^2$ of hydroxyethyl cellulose; a protective layer containing 1.1 mg/ft$^2$ of copper acetate, 3.25 mg/ft$^2$ of chitosan, 5.2 mg/ft$^2$ of gelatin, 0.5 mg/ft$^2$ of 3 micrometer silica particles and stabilizers as described below; a release layer comprising 6 mg/ft$^2$ of hydroxyethyl cellulose and 2 mg/ft$^2$ of polyethylene emulsion; a gelatino silver iodobromide emulsion panchromatically sensitized at a silver coverage of 90 mg/ft$^2$; an antihalation layer comprising gelatin, carboxylated styrene/butadiene copolymer latex, antihalation dyes and a top coat containing 100 mg/ft$^2$ of gelatin, 75 mg/ft$^2$ of carbon black and 20 mg/ft$^2$ of silica particles.

Film units described above were prepared employing the mercaptans and disulfides indicated below. The film units were exposed at 4 mcs at 5500° K. to a multicolor target and processed with mechanical rollers by disposing the processing composition between the top coat and a stripping sheet. The film was held in the dark for one minute and then the top coat and emulsion layers were removed with the stripping sheet.

| Processing Composition | Weight % |
|---|---|
| Sodium hydroxide | 8.54 |
| Hydroxyethyl cellulose (sold by Hercules, Inc., Wilmington, Delaware under the tradename Natrosol 250 HH) | 1.36 |
| Tetramethyl reductic acid | 5.83 |
| Potassium bromide | 0.68 |
| Sodium sulfite | 0.90 |
| 2-methylthiomethyl-4,6-dihydroxypyrimidine | 6.22 |
| 4-aminopyrazolo-[3,4d]-pyrimidine | 0.02 |
| N—benzyl-α-picolinium bromide (50% solution) | 3.11 |
| Water | 73.35 |

Film units were prepared with the indicated compounds in the protective layer and exposed and processed after 5 day room temperature storage as shown in Table 1.

Densities and speeds obtained from the H&D curves generated on an automatic recording densitometer are set forth in the Tables. The $D_{mins}$ reported are density values above the density of the film base and color screen.

TABLE 1

| Example No. | Compounds | $D_{max}/D_{min}$ Red | Green | Blue | 0.7 Intercept Speed Red | Green | Blue |
|---|---|---|---|---|---|---|---|
| 1 (Control) | None | 2.99/ 0.00 | 2.94/ 0.03 | 2.74/ 0.02 | 2.00 | 1.93 | 1.95 |
| 2 (Control) | 0.325/ mg/ft$^2$ (as gold) of gold methylthio-glycolate | 3.05/ 0.00 | 2.97/ 0.01 | 2.77/ 0.02 | 2.02 | 1.97 | 2.00 |
| 3 | 0.325/ mg/ft$^2$ (as gold) of gold methylthio-glycolate 0.325 mg/ft$^2$ of methyl thio-glycolate | 2.98/ 0.00 | 2.88/ 0.01 | 2.69/ 0.02 | 2.09 | 2.05 | 2.10 |

Film units were prepared with the indicated compounds in the protective layer and exposed and processed after accelerated aging consisting of 5 days at 100° F. and 80% relative humidity. The $D_{max}$, $D_{min}$ and 0.7 Intercept Speed are reported in Table 2 as the change between the values set forth in Table 1 and the values obtained after accelerated aging.

TABLE 2

| Example No. | Compounds | $D_{max}/D_{min}$ Red | Green | Blue | 0.7 Intercept Speed Red | Green | Blue |
|---|---|---|---|---|---|---|---|
| 4 (Control) | None | +0.18/ +0.01 | +0.04/ +0.03 | 0.00/ 0.00 | −0.32 | −0.39 | −0.32 |
| 5 (Control) | 0.325 mg/ft$^2$ (as gold) of gold methyl thiogly-colate | −0.94/ +0.01 | −0.83/ +0.02 | −0.77/ −0.01 | −0.24 | −0.32 | −0.23 |
| 6 | 0.325 mg/ft$^2$ (as gold) of gold methyl thiogly-colate 0.325 mg/ft$^2$ of methyl thiogly-colate | −0.25/ −0.01 | −0.04/ −0.02 | −0.09/ −0.01 | −0.31 | −0.37 | −0.25 |

Film units were prepared with the indicated compounds in the protective layer, exposed and processed, and the positive images were subjected to accelerated aging conditions of 5 days at 100° F. and 80% relative humidity. The $D_{max}$, $D_{min}$ and 0.7 Intercept Speed are reported in Table 3 as the differences between the value set forth in Table 1 and the values obtained after accelerated aging.

TABLE 3

| Example No. | Compounds | 0.7 Intercept $D_{max}/D_{min}$ Red | Green | Blue | Speed Red | Green | Blue |
|---|---|---|---|---|---|---|---|
| 7 (Control) | None | −0.48/ +0.01 | −0.21/ 0.00 | −0.03/ −0.02 | +0.04 | +0.05 | +0.05 |
| 8 (Control) | 0.325 mg/ft$^2$ (as gold) of gold methyl thioglycolate | −0.15/ −0.01 | −0.05/ +0.01 | −0.04/ 0.00 | 0.00 | 0.00 | +0.86 |
| | 0.325 mg/ft$^2$ (as gold) of gold methyl thioglycolate 0.325 mg/ft$^2$ of methyl thioglycolate | −0.18/ −0.01 | −0.07/ 0.00 | −0.07/ −0.01 | 0.00 | 0.01 | 0.02 |

The data in Table 3 indicates that the efficiency of the gold methyl thioglycolate is not affected by adding the methyl thioglycolate to the film unit.

Table 4 sets forth room temperature green $D_{max}$ data and the changes from those values on testing obtained on film units containing various levels of the preferred compound of the present invention, dithiodiglycolic acid. Each of the protective layers contains 0.325 mg/ft$^2$ (as gold) of gold methyl thioglycolate.

TABLE 4

| Example | Dithioglycolic Acid | Exposed and processed after 5 days at room temp. Green $D_{max}$ | Exposed and processed after 5 days at 100° F. 80% RH Green $D_{max}$ | Exposed and processed and then held 5 days 80% H & 100° F. Green $D_{max}$ |
|---|---|---|---|---|
| 10 (Control) | None | 2.96 | −1.34 | −0.12 |
| 11 | 0.028 mg/ft$^2$ | 2.92 | −1.23 | −0.09 |
| 12 | 0.14 mg/ft$^2$ | 2.88 | −0.02 | −0.03 |
| 13 | 0.28 mg/ft$^2$ | 2.83 | +0.13 | −0.03 |

The support employed in the present invention is not critical. The support of film base employed may comprise any of the various types of rigid or flexible supports. For example, glass, polymeric films of both the synthetic type and those derived from natural occurring products, including paper, may be employed. If a transparency is desired, a transparent support is employed; if a reflection print is desired, an opaque support is employed. Especially suitable materials comprise flexible transparent synthetic polymers such as polymethacrylic acid; methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate propionate; polycarbonates, polystyrenes and the like.

The additive color screen employed in the present invention may be formed by techniques well known in the art; for example, by sequentially printing the requisite filter patterns by photomechanical methods. An additive color screen comprises an array of sets of colored areas or filter elements usually from 2–4 different colors, each of said sets of colored areas being capable of transmitting visible light within a predetermined wavelength range. In the most common situations, the additive color screen is trichromatic and each set of color filter elements transmits light within one of the so called primary wavelength ranges, i.e., red, green, or blue. The additive color screen may be composed of minute dyed particles such as starch grains or hardened gelatin particles intermixed and interspersed in a regular or random arrangement to provide a mosaic. A regular mosaic of this type may be made by an alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,274 issued Oct. 21, 1958 to Edwin H. Land, or pseudouracils, such as the 4,6-dihydroxy-pyrimidines as taught in U.S. Pat. No. 4,126,459, issued Nov. 21, 1978. While the silver halide solvent is preferably initially present in the processing composition, it is within the scope of this invention is initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The requisite alkalinity, e.g., a pH of 12–14, is preferably imparted to the processing composition, by employing, for example, sodium, potassium and/or lithium hydroxide.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development rection products, etc., the silver halide developing agent(s) should not give rise to colored reaction products which might stain the image or which, either unreacted or reacted, might adversely affect the stability and sensitometric properties of the final image. Particularly useful silver halide developing agents have good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha$, $\beta$-enediols as disclosed in U.S. Pat. No. 3,730,716 issued to Edwin H. Land, Stanley M. Bloom and Leonard C. Farney on May 1, 1973.

What is claimed is:

1. A photographic silver diffusion transfer film unit which comprises a photosensitive silver halide layer, silver precipitating nuclei layer and a protective layer intermediate said silver halide layer and said silver precipitating layer, said protective layer containing a stabilizing compound of the formula:

$$XS(CH_2)_nCOOR$$

wherein X is a noble metal below silver in the Electromotive Series of Elements, n is 1, 2 or 3 and R is an alkyl or substituted alkyl group; and a compound of the formula $$H_xS_y[(CH_2)_bCOOZ]_m$$

wherein Z is hydrogen or alkyl, b is 1, 2 or 3; m is 1 or 2, x is 1 or 0, y is 1 or 2; when y=2, m=2 and x=0; and when y=1, m=1 and x=1.

2. The film unit of claim 1 wherein R is a 1 to 4 carbon alkyl group.

3. The film unit of claim 2 wherein X is gold, palladium or platinum.

4. The film unit of claim 1 wherein said compound is dithiodiglycolic acid.

5. The film unit of claim 1 wherein said compound is methyl thioglycolate.

6. The film unit of claim 1 wherein said stabilizing compound is $AuSCH_2COOCH_3$.

7. The film unit of claim 1 which includes a support.

8. The film unit of claim 1 includes a stripping layer intermediate said protective layer and said photosensitive silver halide layer.

9. The film unit as defined in claim 1 which includes an additive color screen.

10. A photographic process which comprises the steps of:

(a) exposing a film unit which comprises a support carrying, in order, a layer comprising silver precipitating nuclei; a protective layer carrying a stabilizing compound of the formula $$XS(CH_2)_nCOOR$$

wherein X is a noble metal below silver in the Electromative Series of Elements, n is 1, 2 or 3 and R is an alkyl or substituted alkyl group and a compound of the formula $$H_xS_y[(CH_2)_bCOOZ]_m$$

wherein Z is hydrogen or alkyl, b is 1, 2 or 3, m=1 or 2, x=1 or 0 and y=1 or 2, when y=2, m=2 and x=0 and when y=1, m=1 and x=1; a release layer and a photosensitive silver halide emulsion layer;

(b) contacting said exposed film unit with a liquid processing composition; and (c) detaching said photosensitive silver halide emulsion layer from the remainder of the film unit.

11. The process of claim 10 wherein X is gold, palladium or platinum.

12. The process of claim 10 wherein said compound is dithiodiglycolic acid.

13. The process of claim 10 wherein said compound is methylthioglycolate.

14. The process of claim 10 wherein said stabilizing compound is $AuSCH_2COOCH_3$.

15. The process of claim 10 wherein said support is transparent.

16. The process of claim 10 wherein said film unit is an additive color diffusion transfer film unit.

17. A silver diffusion transfer film unit which comprises a support carrying, in order, a layer comprising silver precipitating nuclei; a protective layer; a release layer; and a photosensitive silver halide emulsion layer; wherein said protective layer contains a stabilizing compound of the formula $$XS(CH_2)_nCOOR$$

wherein x is a noble metal below silver in the Electromotive Series of Elements, n is 1, 2 or 3 and R is an alkyl or substituted alkyl group; and a compound of the formula $$H_xS_y[(CH_2)_bCOOZ]_m$$

wherein Z is hydrogen or alkyl, b is 1, 2 or 3; m is 1 or 2, x is 1 or 0, y is 1 or 2; when y=2, m=2 and x=0; and when y=1, m=1 and x=1.

18. The film unit of claim 17 wherein said stabilizing compound is gold methyl thioglycolate and said compound is dithiodiglycolic acid.

* * * * *